US007830231B2

(12) United States Patent
Carlino et al.

(10) Patent No.: US 7,830,231 B2
(45) Date of Patent: Nov. 9, 2010

(54) TRIP ACTUATOR INCLUDING A THERMOPLASTIC BUSHING, AND TRIP UNIT AND ELECTRICAL SWITCHING APPARATUS INCLUDING THE SAME

(75) Inventors: Harry James Carlino, Exportr, PA (US); Lloyd Allen Maloney, Beaver, PA (US); Joseph Bell Humbert, Monaca, PA (US); Martha Suryani, Coraopolis, PA (US)

(73) Assignee: Eaton Corporation, Cleveland, OH (US)

( * ) Notice: Subject to any disclaimer, the term of this patent is extended or adjusted under 35 U.S.C. 154(b) by 346 days.

(21) Appl. No.: 12/032,864

(22) Filed: Feb. 18, 2008

(65) Prior Publication Data

US 2009/0206969 A1 Aug. 20, 2009

(51) Int. Cl.

| | |
|---|---|
| ***H01H 9/00*** | (2006.01) |
| ***H01H 75/00*** | (2006.01) |
| ***H01H 77/00*** | (2006.01) |
| ***H01H 83/00*** | (2006.01) |
| ***H01H 51/30*** | (2006.01) |
| ***H01H 67/00*** | (2006.01) |
| ***H01H 9/02*** | (2006.01) |
| ***H01H 13/04*** | (2006.01) |
| ***H01F 7/00*** | (2006.01) |
| ***H01F 3/00*** | (2006.01) |

(52) U.S. Cl. ..... 335/174; 335/6; 335/21; 335/102; 335/106; 335/172; 335/202; 335/220; 335/229; 335/255; 335/261; 335/273; 335/279; 335/281

(58) Field of Classification Search ..... 335/6, 335/8, 10, 21, 63, 65, 68, 77, 102, 106, 126, 335/172, 173, 174, 192, 195, 202, 220, 229, 335/230, 249, 251, 255, 260, 261, 262, 273, 335/279, 281

See application file for complete search history.

(56) References Cited

U.S. PATENT DOCUMENTS

| | | | | |
|---|---|---|---|---|
| 5,341,191 | A | 8/1994 | Crookston et al. | |
| 5,453,724 | A * | 9/1995 | Seymour et al. | 335/172 |
| 5,626,327 | A * | 5/1997 | Clark | 251/129.15 |

(Continued)

FOREIGN PATENT DOCUMENTS

JP 57094141 A * 6/1982

(Continued)

*Primary Examiner*—Elvin G Enad
*Assistant Examiner*—Mohamad A Musleh
(74) *Attorney, Agent, or Firm*—Martin J. Moran

(57) ABSTRACT

A circuit breaker includes separable contacts, an operating mechanism structured to open and close the contacts, and a trip unit cooperating with the operating mechanism to trip open the contacts. The trip unit includes a sensor structured to sense current flowing through the contacts, a processor structured to output a trip signal responsive to the sensed current, and a trip actuator. The trip actuator includes a housing including a recess, a coil within the recess, the coil having an opening therethrough, a magnet within the recess, a thermoplastic bushing including a conduit therethrough, the thermoplastic bushing being coupled to the housing, and an armature disposable within the opening of the coil and slidably disposed within the conduit of the thermoplastic bushing. The magnet attracts the armature toward the housing. A spring biases the armature away from the housing, in order to cause the operating mechanism to trip open the contacts.

19 Claims, 5 Drawing Sheets

U.S. PATENT DOCUMENTS 5,886,605 A * 3/1999 Ulerich et al. ..... 335/172
5,910,760 A 6/1999 Malingowski et al.
6,137,386 A 10/2000 Mueller
6,144,271 A 11/2000 Mueller et al.
6,218,921 B1 4/2001 Eberts et al.
6,853,279 B1 2/2005 Puskar et al.
2004/0257185 A1* 12/2004 Telep ..... 335/220
2005/0024173 A1* 2/2005 Puskar et al. ..... 335/172
2005/0093664 A1* 5/2005 Lanni et al. ..... 335/220

FOREIGN PATENT DOCUMENTS

JP 06140237 A * 5/1994

* cited by examiner

TRIP ACTUATOR INCLUDING A THERMOPLASTIC BUSHING, AND TRIP UNIT AND ELECTRICAL SWITCHING APPARATUS INCLUDING THE SAME

BACKGROUND OF THE INVENTION

1. Field of the Invention

This invention pertains generally to electrical switching apparatus and, more particularly, to circuit interrupters including a trip unit. The invention also pertains to trip units for circuit interrupters. The invention further pertains to trip actuators for trip units.

2. Background Information

Electrical switching apparatus include, for example, circuit switching devices; circuit interrupters, such as circuit breakers; network protectors; contactors; motor starters; motor controllers; and other load controllers. Electrical switching apparatus such as circuit interrupters and, in particular, circuit breakers of the molded case variety, are well known in the art. See, for example, U.S. Pat. No. 5,341,191.

Circuit breakers are used to protect electrical circuitry from damage due to an overcurrent condition, such as an overload condition or a relatively high level short circuit or fault condition. Molded case circuit breakers typically include a pair of separable contacts per phase. The separable contacts may be operated either manually by way of a handle disposed on the outside of the case or automatically in response to an overcurrent condition. Typically, such circuit breakers include an operating mechanism, which is designed to rapidly open and close the separable contacts, and a trip unit, which senses overcurrent conditions in an automatic mode of operation. Upon sensing an overcurrent condition, the trip unit trips the operating mechanism to a trip state, which moves the separable contacts to their open position. See, for example, U.S. Pat. Nos. 5,910,760; and 6,144,271.

U.S. Pat. No. 6,853,279 discloses a trip actuator including a bobbin assembly, a disk spacer, a disc magnet, which is preferably magnetized after certain assembly steps, a housing, a cover, a wave washer, an upper bushing, an armature or plunger, a lower bushing, an internal retaining ring, a spring and a set screw.

A known trip actuator consists of twelve parts, including an impregnated or coated set screw for spring adjustment, a brass bushing and a brass sleeve. The impregnated set screw is used to adjust spring compression and, therefore, trip force. The threads of the set screw are impregnated with a material that locks the set screw after it has been adjusted. However, it is believed that adjusting the screw might cause particles of the impregnated material in the threads to break free and potentially interfere with the operation of, and interface between, the bottom surface of the armature and the disc spacer. Hence, such debris might prevent proper magnetic seal force for the armature or plunger and, therefore, might cause magnetic shock out. As a result, the actuator force might be released prematurely due to mechanical vibration.

Hence, there is room for improvement in trip actuators for trip units.

There is also room for improvement in trip units including a trip actuator.

There is further room for improvement in electrical switching apparatus, such as circuit interrupters, including a trip unit having a trip actuator.

SUMMARY OF THE INVENTION

These needs and others are met by embodiments of the invention, which provide a trip actuator in which a thermoplastic bushing includes a conduit therethrough. The thermoplastic bushing is coupled to a housing of the trip actuator. An armature of the trip actuator is disposable within an opening of a coil and is slidably disposed within the conduit of the thermoplastic bushing. Preferably, the armature includes a shoulder and the thermoplastic bushing is structured to act as a stop for the armature. The armature also preferably includes an elongated internal recess that receives a spring.

In accordance with one aspect of the invention, an electrical switching apparatus comprises: separable contacts; an operating mechanism structured to open and close the separable contacts; and a trip unit cooperating with the operating mechanism to trip open the separable contacts, the trip unit comprising: a sensor structured to sense current flowing through the separable contacts, a processor structured to output a trip signal responsive to the sensed current, and a trip actuator comprising: a housing including a recess, a coil within the recess of the housing, the coil having an opening therethrough, a magnet within the recess of the housing, a thermoplastic bushing including a conduit therethrough, the thermoplastic bushing being coupled to the housing, and an armature disposable within the opening of the coil and slidably disposed within the conduit of the thermoplastic bushing, the magnet attracting the armature toward the housing; and a spring biasing the armature away from the housing, in order to cause the operating mechanism to trip open the separable contacts.

The housing may further include a cover having an opening therein; and the armature may include a first end structured to pass through the opening of the cover and a second end opposite the first end, the second end including an opening therein, the spring engaging the armature within the opening of the second end thereof.

The second end of the armature may be disposable within the opening of the coil; and the first end of the armature may be slidably disposed within the conduit of the thermoplastic bushing and may be structured to pass through the opening of the cover.

The first end of the armature may be a plunger having a first diameter; the second end of the armature may have a second diameter, which is larger than the first diameter; the opening of the second end may be an elongated recess passing through the second end of the armature and into the plunger of the armature; and the spring may be an elongated compression coil spring extending within the elongated recess of the second end of the armature.

As another aspect of the invention, a trip unit is for a circuit interrupter comprising separable contacts and an operating mechanism structured to open and close the separable contacts. The trip unit comprises: a sensor structured to sense current flowing through the separable contacts; a processor structured to output a trip signal responsive to the sensed current; and a trip actuator comprising: a first sub-assembly comprising: a housing including a recess, a coil within the recess of the housing, the coil having an opening therethrough, and a magnet within the recess of the housing; a second sub-assembly within the recess of the housing of the first sub-assembly, the second sub-assembly comprising: a thermoplastic bushing including a conduit therethrough, the thermoplastic bushing being coupled to the housing of the first sub-assembly, and an armature disposable within the opening of the coil and slidably disposed within the conduit of the thermoplastic bushing, and a spring structured to bias the armature away from the first sub-assembly, in order to cause the operating mechanism to trip open the separable contacts, wherein the magnet is structured to overcome the spring and attract the armature toward the first sub-assembly.

The conduit of the thermoplastic bushing may be a first conduit; the second sub-assembly may further comprise a cover including a generally flat portion having an opening therein and a second conduit extending from the generally flat portion, the second conduit forming a continuous opening from the opening of the generally flat portion through the second conduit; and the thermoplastic bushing may be coupled to the cover at the second conduit and form a continuous opening through the first conduit of the thermoplastic bushing and through the second conduit of the cover.

As another aspect of the invention, a trip actuator is for a trip unit. The trip actuator comprises: a first sub-assembly comprising: a housing including a recess, a coil within the recess of the housing, the coil having an opening therethrough, and a magnet within the recess of the housing; a second sub-assembly within the recess of the housing of the first sub-assembly, the second sub-assembly comprising: a thermoplastic bushing including a conduit therethrough, the thermoplastic bushing being coupled to the housing of the first sub-assembly, and an armature disposable within the opening of the coil and slidably disposed within the conduit of the thermoplastic bushing, the magnet attracting the armature toward the first sub-assembly; and a spring biasing the armature away from the first sub-assembly.

The second sub-assembly may further comprise a cover including an opening therein; the thermoplastic bushing may be coupled to the cover at the opening thereof; and the armature may include a first end structured to pass through the opening of the cover and a second end opposite the first end, the second end including an opening therein, the spring engaging the armature within the opening of the second end thereof.

The first end of the armature may be a plunger having a first diameter; the second end of the armature may have a second diameter, which is larger than the first diameter; and the opening of the second end may be an elongated recess passing through the second end of the armature and into the plunger of the armature.

The first end and the second end of the armature may form a shoulder therebetween; and the shoulder may be structured to engage the thermoplastic bushing when the coil is energized and the spring forces the armature away from the first sub-assembly.

The second sub-assembly may further comprise a cover including an opening therein, a portion of the armature being structured to pass through the opening of the cover; the conduit of the thermoplastic bushing may be a first conduit; the cover may further include a generally flat portion having the opening therein and a second conduit extending from the generally flat portion, the second conduit forming a continuous opening from the opening of the generally flat portion through the second conduit; and the thermoplastic bushing may be coupled to the cover at the second conduit and form a continuous opening through the first conduit of the thermoplastic bushing and through the second conduit of the cover.

The first conduit of the thermoplastic bushing may be press fit to the cover within the second conduit of the cover.

As another aspect of the invention, a trip actuator for a trip unit comprises: a first sub-assembly comprising: a housing including a recess, a coil within the recess of the housing, the coil having an opening therethrough, and a magnet within the recess of the housing; a second sub-assembly within the recess of the housing of the first sub-assembly, the second sub-assembly comprising: a bushing including a conduit therethrough, an armature disposable within the opening of the coil and slidably disposed within the conduit of the bushing, the magnet attracting the armature toward the first sub-assembly, and a cover including an opening therein, the bushing being coupled to the cover at the opening thereof, the cover being coupled to the housing of the first sub-assembly; and a spring biasing the armature away from the first sub-assembly, wherein the armature includes a first end structured to pass through the opening of the cover and a second end opposite the first end, the second end including an opening therein, the spring engaging the armature within the opening of the second end thereof.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "coupled" together means that the parts are joined together either directly or joined through one or more intermediate parts.

The invention is described in association with a trip actuator for a trip unit of a three-pole circuit breaker, although the invention is applicable to a wide range of electrical switching apparatus having any number of poles.

Figure 1:
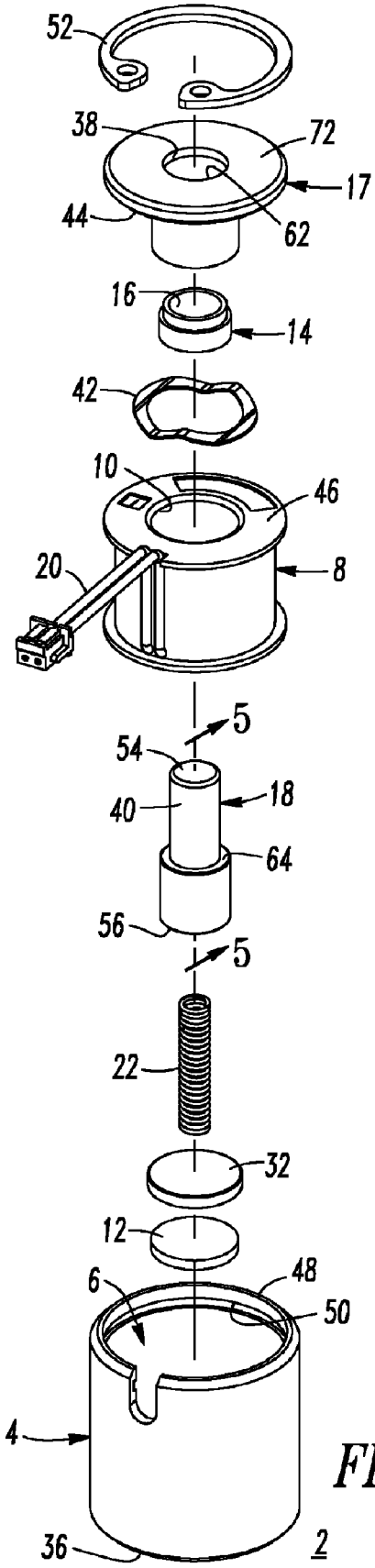
FIG. 1 is an exploded isometric view of a trip actuator in accordance with embodiments of the invention.

Referring to FIG. 1, a trip actuator 2 is shown. The trip actuator 2 includes a housing 4 having a recess 6 and a coil, such as the example bobbin assembly 8, which is disposed within the housing recess 6 (as can be seen from FIGS. 2 and 4). The bobbin assembly 8 has an opening 10 therethrough. A magnet 12 is also disposed within the recess 6. The trip actuator 2 further includes an example thermoplastic bushing 14 having a conduit 16 therethrough.

EXAMPLE

A non-limiting example of a suitable thermoplastic material for the example thermoplastic bushing 14 is polyoxymethylene (POM), which is marketed by E. I. du Pont de Nemours and Company of Wilmington, Del. under the brand name DELRIN®.

Alternatively, any suitable low-friction and wear-resistant thermoplastic with good physical and processing properties and being capable of operating in temperatures of up to about 85° C. may be employed.

Figure 6:
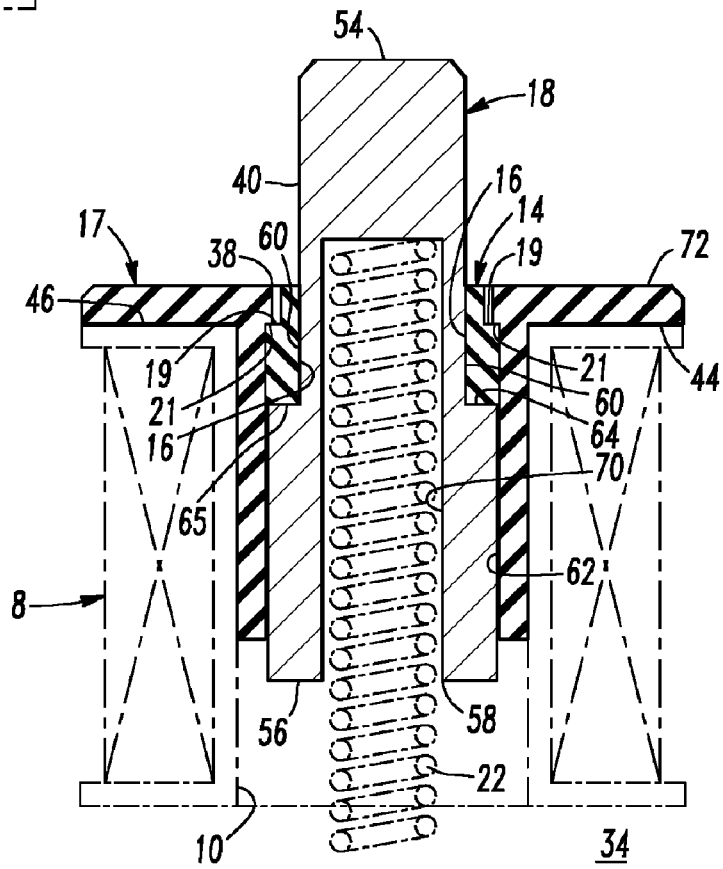
FIG. 6 is a cross-sectional view along lines 6-6 of FIG. 3.
Figure 8:
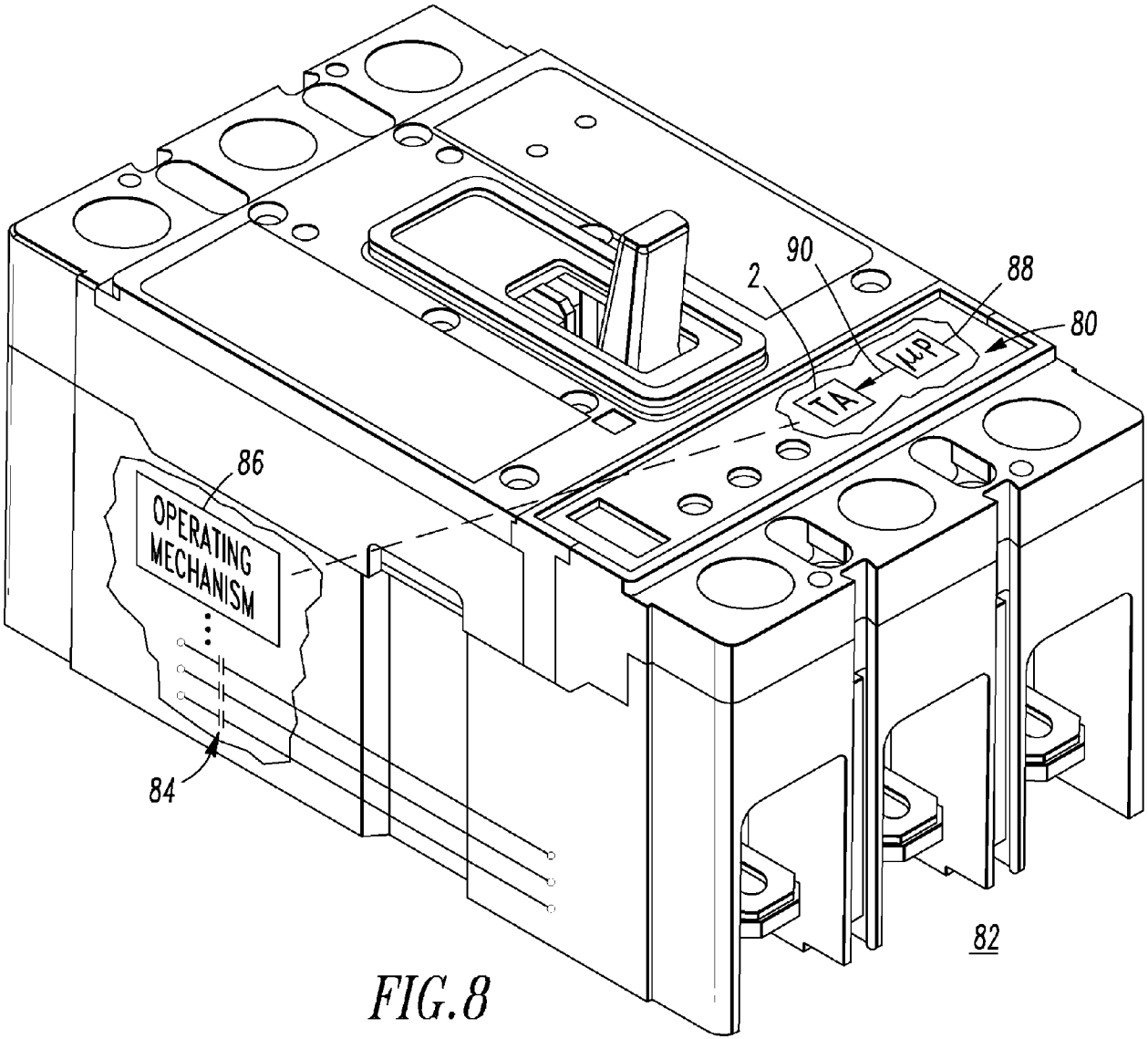
FIG. 8 is an isometric view of a circuit breaker including the trip unit of FIG. 7.

The bushing 14 is coupled to the housing 4 through the cover 17 as will be explained. The trip actuator 2 also includes an armature 18 disposable within the coil opening 10 (as can be seen from FIGS. 1-3) and slidably disposed within the bushing conduit 16 (as shown in FIG. 6). Normally, the magnet 12 attracts the armature 18 toward the housing 4 (e.g., without limitation, downward with respect to FIG. 1) and overcomes the force of a spring 22 in the opposite direction (e.g., without limitation, upward with respect to FIG. 1). The armature 18 is disposable within the bobbin assembly opening 10 (as can be seen from FIG. 3). As will be explained, when the bobbin assembly 8 is energized through the conductors 20, the spring 22 biases the armature 18 away from the housing 4. This causes the operating mechanism 86 (FIG. 8) to trip open the separable contacts 84 (FIG. 8) of a corresponding circuit breaker 82 (FIG. 8).

The bushing 14 is, for example, a thermoplastic guide-bushing or thermoplastic press fit insert, which acts as a superior armature bushing surface and guide for the armature 18.

Figure 2:
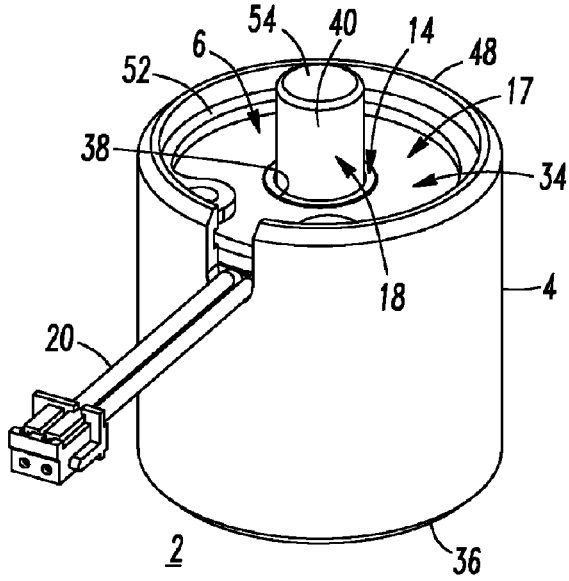
FIG. 2 is an isometric view of the trip actuator of FIG. 1.
Figure 4:
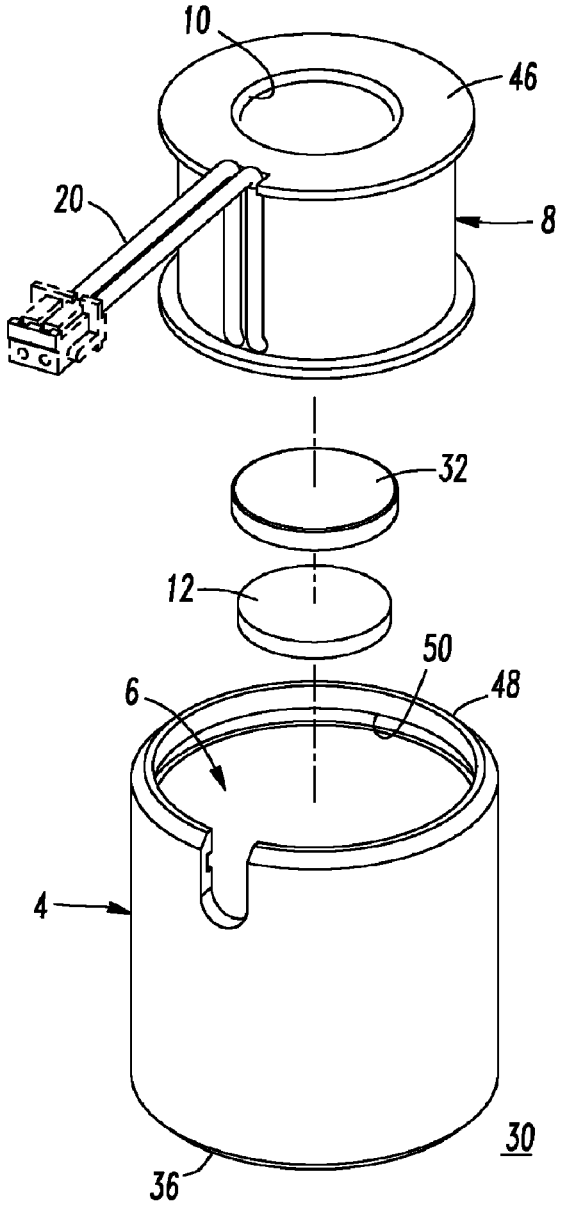
FIG. 4 is an exploded isometric view of the housing, magnet, spacer and coil assembly of the trip actuator of FIG. 1.

As shown in FIG. 4, a first sub-assembly 30 is formed from the housing 4, the magnet 12 within the housing recess 6, the spacer 32 within the recess 6 and the bobbin assembly 8 within the recess 6. The spacer 32 functions as a flux coupler. As shown in FIGS. 2 and 6, a second sub-assembly 34 is also within the housing recess 6 and is formed by the cover 17, the bushing 14 and the armature 18. The example magnet 12 (FIG. 1) is adjacent the closed end 36 of the housing 4. The spacer 32 is adjacent the magnet 12 within the housing recess 6.

Preferably, the magnet 12 is magnetized after the sub-assembly 30 of FIG. 4 is assembled, in order to provide a more uniform and consistent magnetic field strength, to provide more predictable tripping without subsequent manufacturing adjustment, and to facilitate the convenient assembly of the non-magnetized magnet 12. The non-magnetized magnet 12 is inserted into the recess 6 of the housing 4 followed by the spacer 32. For example, a suitable magnetizer (not shown), such as a Model 7500/900-6i marketed by Magnetic Instruments of Indianapolis, Ind., may be employed to magnetize the non-magnetized magnet 12 within the assembly of the final trip actuator 2 (as shown in FIG. 2).

Referring to FIGS. 1 and 2, the cover 17 includes an opening 38 therein. A portion, such as the example plunger 40, of the armature 18 is structured to pass through the cover opening 38. A wave washer 42 is disposed between the lower (with respect to FIG. 1) surface 44 of the cover 17 and the upper (with respect to FIG. 1) surface 46 of the bobbin assembly 8. The housing 4 includes an open end 48 opposite the closed end 36 thereof. The housing recess 6 extends from the open end 48 toward the closed end 36. A rim 50 is at the open end 48 of the housing 4. The sub-assembly 34 is inserted into the recess 6 of the housing 4 of the sub-assembly 30 (FIG. 4). A retaining ring 52 engages the rim 50 and holds the second sub-assembly 34, which includes the cover 17, bushing 14 and armature 18 of FIG. 3, within the housing recess 6 against a force provided by the wave washer 42 as is disposed against the bobbin assembly surface 46. The spring 22 extends from the spacer 32 to the end 94 of the elongated armature recess 70 (as shown in FIG. 5).

The magnet 12 provides a first magnetic force (e.g., without limitation, downward with respect to FIG. 1) to attract the armature 18 toward the first sub-assembly 30 (FIG. 4) and, in particular, toward the magnet 12 at the closed end 36 of the housing 4 and away from the cover opening 38. When the coil (not shown) of the bobbin assembly 8 is energized through the conductors 20, a second magnetic force (e.g., without limitation, upward with respect to FIG. 1) from the coil is opposite the first magnetic force and sufficiently overcomes the first magnetic force from the magnet 12, in order that the spring 22 forces the armature 18 away from the first sub-assembly 30 and through the cover opening 38 (e.g., as shown by the plunger 40 of FIG. 2).

Figure 3:
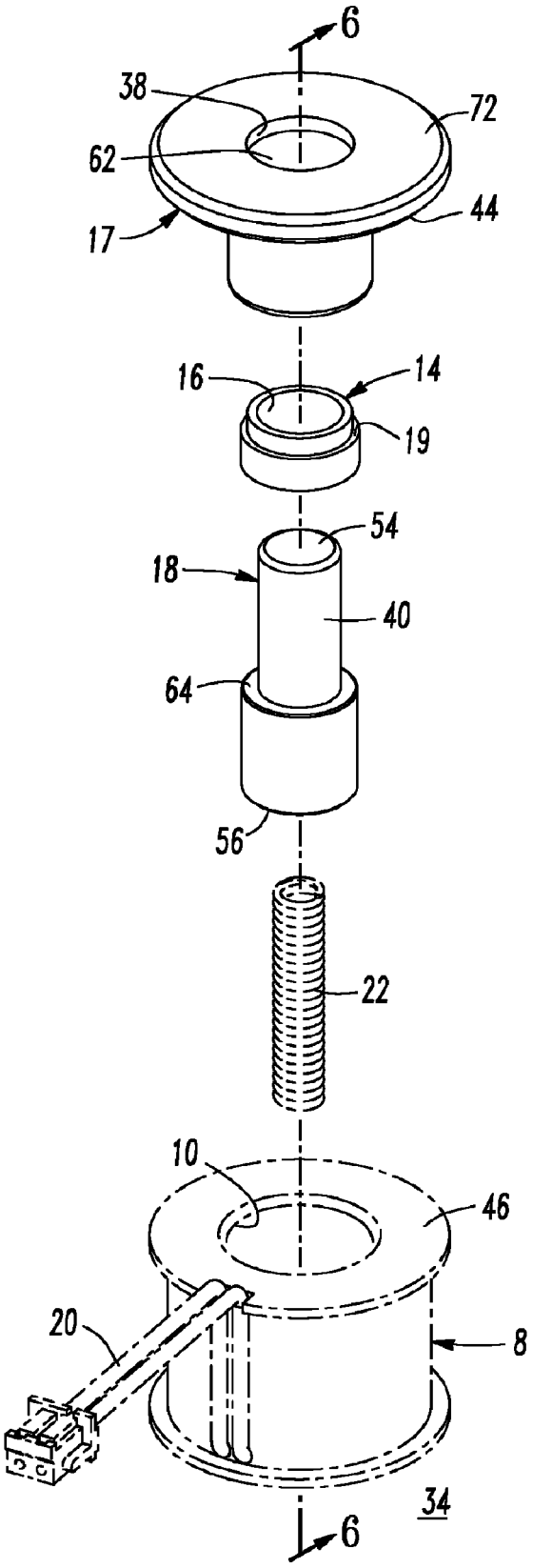
FIG. 3 is an exploded isometric view of the cover, thermoplastic bushing and armature of the trip actuator of FIG. 1.
Figure 5:
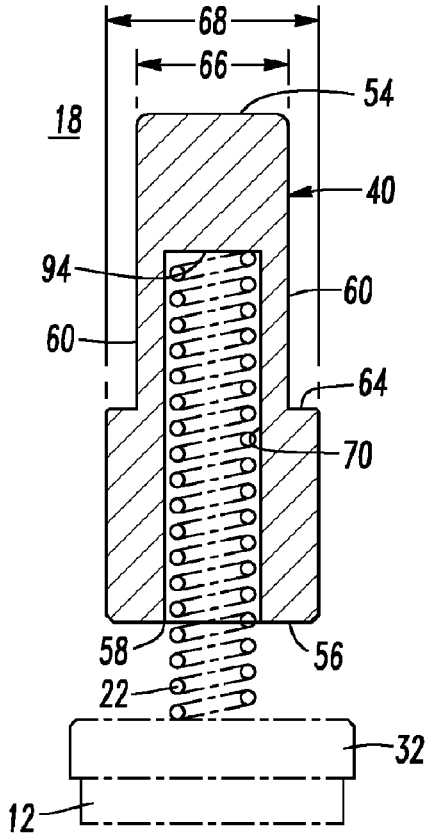
FIG. 5 is a cross-sectional view along lines 5-5 of FIG. 1.

Referring to FIGS. 3 and 5, the second sub-assembly 34 is shown along with the spring 22 (in phantom line drawing) and the bobbin assembly 8 (in phantom line drawing in FIG. 3). The armature 18 includes a first end 54 of the plunger 40, which is structured to pass through the opening 38 of the cover 17, and a second end 56 opposite the first end 54. The second end 56 includes an opening 58 (FIG. 5) therein. The spring 22 engages the armature 18 within the opening 58. The second end 56 of the armature 18 is disposable within the opening 10 of the bobbin assembly 8. The armature 18 is slidably disposed along the surface 60 of the plunger 40 within the conduit 16 of the thermoplastic bushing 14 as shown in FIG. 6. The thermoplastic bushing 14 is press fit to the cover 17 within the cover conduit 62. A shoulder 19 of the thermoplastic bushing 14 engages an internal surface 21 of the cover 17.

The first and second ends 54,56 of the armature 18 form a shoulder 64 therebetween. The shoulder 64 is structured to engage the thermoplastic bushing 14 at end 65 (FIG. 6) and be stopped thereby when the bobbin assembly 8 is energized and the spring 22 forces the armature 18 away from the first sub-assembly 30 (FIG. 4).

FIG. 4 shows the first sub-assembly 30, which includes the housing 4, the magnet 12, the spacer 32 and the bobbin assembly 8.

As shown in FIG. 5, the first end 54 and the plunger 40 of the armature 18 have a first diameter 66 and the armature second end 56 has a larger second diameter 68. The opening 58 of the second end 56 is an elongated recess 70 passing through the second end 56 and into the plunger 40. The spring 22 (shown in phantom line drawing) is an elongated compression coil spring extending from the spacer 32 (FIG. 1) to within the elongated recess 70 of the armature 18.

FIG. 6 shows the second sub-assembly 34, which includes the cover 17, thermoplastic bushing 14 and armature 18. The spring 22 is also shown in phantom line drawing. The cover 17 includes a generally flat portion 72 having the opening 38 therein and the conduit 62 extending from the generally flat portion 72. The conduit 62 forms a continuous opening from the opening 38 through the conduit 62 of the cover 17. The thermoplastic bushing 14 is coupled to the cover 17 at the conduit 62 and forms a continuous opening through the thermoplastic bushing conduit 16 and through the cover conduit 62. As best shown in FIG. 2, a portion of the armature 18, namely the plunger 40, is structured to pass through the cover opening 38.

Figure 7:
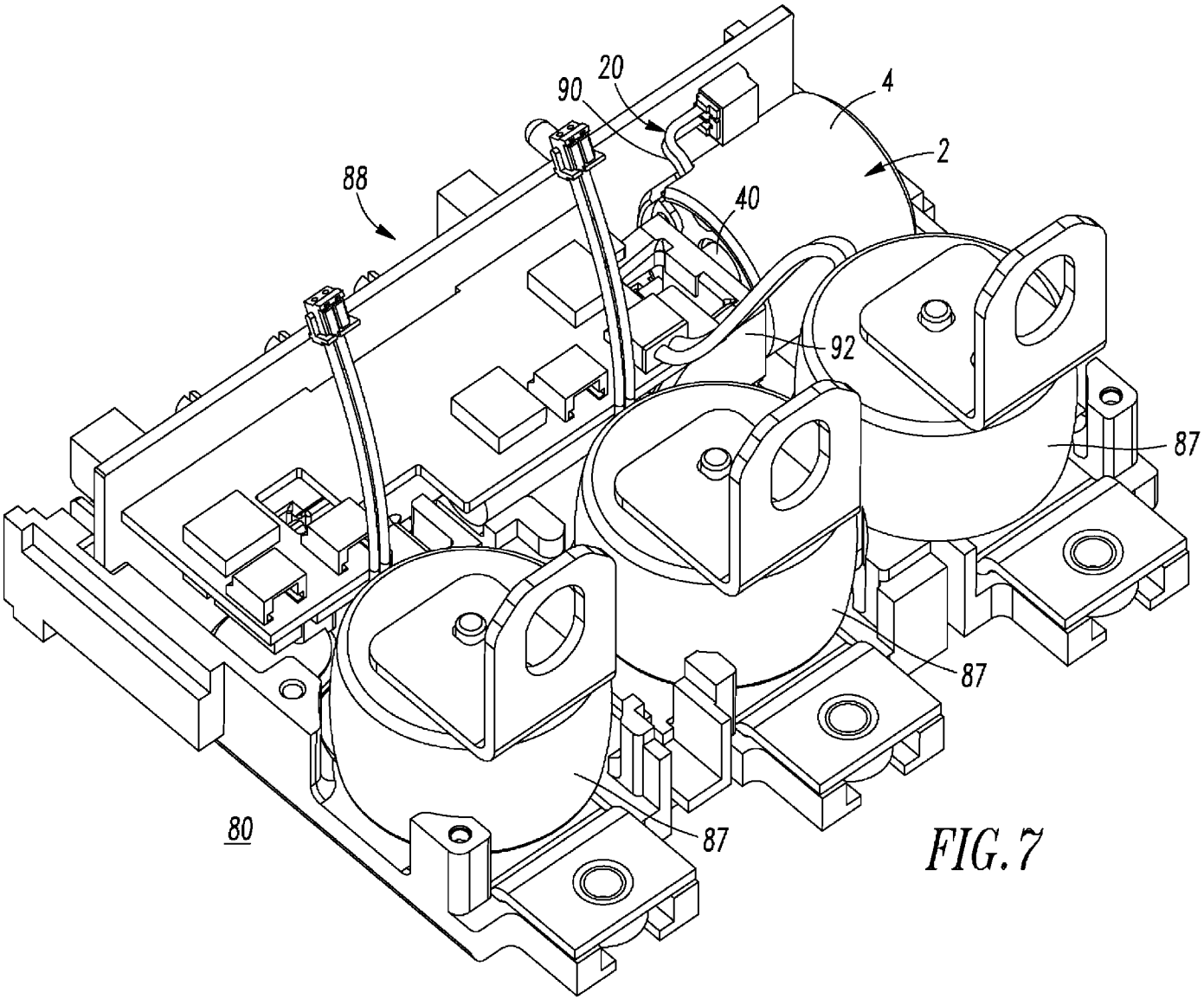
FIG. 7 is an isometric view of a portion of a trip unit including the trip actuator of FIG. 1.

Referring to FIG. 7, a portion of a trip unit 80 including the trip actuator 2 of FIG. 1 is shown. The trip unit 80 is for a circuit interrupter, such as the example circuit breaker 82 of FIG. 8. As is conventional, the circuit breaker 82 includes separable contacts 84 and an operating mechanism 86 structured to open and close the separable contacts 84. The trip unit 80, which is also shown in FIG. 8, includes a number of sensors 87 structured to sense current flowing through the separable contacts 84 and a processor (μP) 88 structured to output a trip signal 90 to the trip actuator (TA) 2 responsive to the sensed current. The bobbin assembly 8 (FIG. 1) of the trip actuator 2 is energizable by the trip signal 90 through the conductors 20. The trip unit 80 also includes a trip lever 92 cooperating with the operating mechanism 86 to trip open the separable contacts 84. The armature plunger 40 engages the trip lever 92 responsive to the bobbin assembly 8 being energized by the trip signal 90.

When the bobbin assembly 8 of FIG. 1 is energized through the conductors 20 by the trip unit 80 in response to a detected trip condition, the resulting repelling magnetic force on the armature 18 sufficiently overcomes the attracting magnetic force of the magnetized magnet 12, in order that the spring 22 biases the armature 18 and, thus, the plunger 40 thereof away from the trip actuator housing 4 (to the extended position of the plunger 40 shown in FIG. 2). In turn, the plunger 40 engages and moves the trip lever 92 of the trip unit 80 (FIG. 7).

An example of a trip unit, excluding the disclosed trip actuator 2, is disclosed in U.S. Pat. No. 6,853,279, which is incorporated by reference herein.

Examples of circuit breakers and circuit breaker frames, excluding the disclosed trip actuator 2, are disclosed in U.S. Pat. Nos. 5,910,760; 6,137,386; 6,144,271; and 6,853,279, which are incorporated by reference herein.

The disclosed trip actuator 2 does not employ any set screw. Furthermore, the disclosed trip actuator 2 includes fewer parts than known prior trip actuators with no loss in robustness. The trip actuator 2 is also easily scalable if more force or stroke is desired.

The example thermoplastic bushing 14 precludes the possibility of brass particles (not shown) from a brass bushing (not shown) from entering the interface between the spacer 32 and the armature end 56 (see FIG. 5, which shows the armature 18 being actuated by the spring 22 (shown in phantom line drawing) away from the spacer 32 and the magnet 12 (shown in phantom line drawing)). Such brass particles could cause a relatively poor magnetic seal and, therefore, shock out (e.g., a trip caused by mechanical vibration).

Furthermore, the example single thermoplastic bushing 14 prevents the armature 18 from binding on the cover 17 (FIG. 6), which might cause inconsistent tripping results.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical switching apparatus comprising:

separable contacts;

an operating mechanism structured to open and close said separable contacts; and a trip unit cooperating with said operating mechanism to trip open said separable contacts, said trip unit comprising:

a sensor structured to sense current flowing through said separable contacts, a processor structured to output a trip signal responsive to said sensed current, and a trip actuator comprising:

a housing including a recess, a coil within the recess of the housing, the coil having an opening therethrough, a magnet within the recess of the housing, a thermoplastic bushing including a conduit therethrough, the thermoplastic bushing being coupled to the housing, and an armature disposable within the opening of the coil and slidably disposed within the conduit of the thermoplastic bushing, the magnet attracting the armature toward said housing; and a spring biasing the armature away from said housing, in order to cause said operating mechanism to trip open said separable contacts, wherein said housing further includes a cover having an opening therein, wherein the armature includes a first end structured to pass through the opening of the cover and a second end opposite the first end, the second end including an opening therein, said spring engaging the armature within the opening of the second end thereof, and wherein the armature slidably engages the thermoplastic bushing at said conduit.

2. The electrical switching apparatus of claim 1 wherein the second end of the armature is disposable within the opening of the coil; and wherein the first end of the armature is slidably disposed within the conduit of the thermoplastic bushing and is structured to pass through the opening of the cover.

3. The electrical switching apparatus of claim 1 wherein the first end of the armature is a plunger having a first diameter; wherein the second end of the armature has a second diameter, which is larger than said first diameter; wherein the opening of the second end is an elongated recess passing through the second end of the armature and into the plunger of the armature; and wherein said spring is an elongated compression coil spring extending within the elongated recess of the second end of the armature.

4. A trip unit for a circuit interrupter comprising separable contacts and an operating mechanism structured to open and close said separable contacts, said trip unit comprising:

a sensor structured to sense current flowing through said separable contacts;

a processor structured to output a trip signal responsive to said sensed current; and a trip actuator comprising:

a first sub-assembly comprising:

a housing including a recess, a coil within the recess of the housing, the coil having an opening therethrough, and a magnet within the recess of the housing;

a second sub-assembly within the recess of the housing of said first sub-assembly, said second sub-assembly comprising:

a thermoplastic bushing including a conduit therethrough, the thermoplastic bushing being coupled to the housing of said first sub-assembly, and an armature disposable within the opening of the coil and slidably disposed within the conduit of the thermoplastic bushing, and a spring structured to bias the armature away from said first sub-assembly, in order to cause said operating mechanism to trip open said separable contacts, wherein the magnet is structured to overcome said spring and attract the armature toward said first sub-assembly, wherein the conduit of the thermoplastic bushing is a first conduit; wherein said second sub-assembly further comprises a cover including a generally flat portion having an opening therein and a second conduit extending from said generally flat portion, said second conduit forming a continuous opening from the opening of the generally flat portion through said second conduit, wherein the thermoplastic bushing is coupled to the cover at the second conduit and forms a continuous opening through the first conduit of the thermoplastic bushing and through the second conduit of the cover, and wherein the armature slidably engages the thermoplastic bushing at said first conduit.

5. The trip unit of claim 4 wherein the coil is energizable by said trip signal.

6. The trip unit of claim 5 wherein the magnet provides a first magnetic force to attract the armature toward said first sub-assembly and away from the opening of the cover; and wherein when the coil is energized by said trip signal, a second magnetic force from the coil is opposite said first magnetic force and sufficiently overcomes said first magnetic force, in order that said spring forces the armature away from said first sub-assembly and through the opening of the cover.

7. The trip unit of claim 6 wherein said trip unit further comprises a trip lever cooperating with said operating mechanism to trip open said separable contacts; and wherein the armature engages the trip lever responsive to the coil being energized by said trip signal.

8. A trip actuator for a trip unit, said trip actuator comprising:

a first sub-assembly comprising:

a housing including a recess, a coil within the recess of the housing, the coil having an opening therethrough, and a magnet within the recess of the housing;

a second sub-assembly within the recess of the housing of said first sub-assembly, said second sub-assembly comprising:

a thermoplastic bushing including a conduit therethrough, the thermoplastic bushing being coupled to the housing of said first sub-assembly, and an armature disposable within the opening of the coil and slidably disposed within the conduit of the thermoplastic bushing, the magnet attracting the armature toward said first sub-assembly; and a spring biasing the armature away from said first sub-assembly, wherein said second sub-assembly further comprises a cover including an opening therein, wherein the thermoplastic bushing is coupled to the cover at the opening thereof, wherein the armature includes a first end structured to pass through the opening of the cover and a second end opposite the first end, the second end including an opening therein, said spring engaging the armature within the opening of the second end thereof, and wherein the armature slidably engages the thermoplastic bushing at said conduit.

9. The trip actuator of claim 8 wherein the second end of the armature is disposable within the opening of the coil; and wherein the first end of the armature is slidably disposed within the conduit of the thermoplastic bushing and is structured to pass through the opening of the cover.

10. The trip actuator of claim 8 wherein the first end of the armature is a plunger having a first diameter; wherein the second end of the armature has a second diameter, which is larger than said first diameter; and wherein the opening of the second end is an elongated recess passing through the second end of the armature and into the plunger of the armature.

11. The trip actuator of claim 10 wherein the first end and the second end of the armature form a shoulder therebetween; and wherein said shoulder is structured to engage the thermoplastic bushing when said coil is energized and said spring forces the armature away from said first sub-assembly.

12. The trip actuator of claim 10 wherein said spring is an elongated compression coil spring extending from said first sub-assembly to within the elongated recess of the second end of the armature.

13. The trip actuator of claim 8 wherein the housing includes a closed end and an opposite open end, the recess of the housing extending from the opposite open end toward said closed end; wherein the housing further includes a rim at the opposite open end thereof; and wherein a retaining ring engages said rim and holds said second sub-assembly within the recess of the housing.

14. The trip actuator of claim 13 wherein said first sub-assembly further comprises a spacer within the recess of the housing, said magnet being adjacent said closed end; and wherein the spacer is adjacent said magnet within the recess of the housing.

15. The trip actuator of claim 8 wherein a wave washer is disposed between the cover and the coil.

16. The trip actuator of claim 8 wherein the conduit of the thermoplastic bushing is a first conduit; wherein the cover further includes a generally flat portion having the opening therein and a second conduit extending from said generally flat portion, said second conduit forming a continuous opening from the opening of the generally flat portion through said second conduit; and wherein the thermoplastic bushing is coupled to the cover at the second conduit and forms a continuous opening through the first conduit of the thermoplastic bushing and through the second conduit of the cover.

17. The trip actuator of claim 16 wherein the thermoplastic bushing is press fit to the cover within the second conduit of the cover.

18. The trip actuator of claim 8 wherein the thermoplastic bushing is made of polyoxymethylene.

19. A trip actuator for a trip unit, said trip actuator comprising:

a first sub-assembly comprising:

a housing including a recess, a coil within the recess of the housing, the coil having an opening therethrough, and a magnet within the recess of the housing;

a second sub-assembly within the recess of the housing of said first sub-assembly, said second sub-assembly comprising:

a thermoplastic bushing including a conduit therethrough, an armature disposable within the opening of the coil and slidably disposed within the conduit of the thermoplastic bushing, the magnet attracting the armature toward said first sub-assembly, and a cover including an opening therein, the thermoplastic bushing being coupled to the cover at the opening thereof, the cover being coupled to the housing of said first sub-assembly; and a spring biasing the armature away from said first sub-assembly, wherein the armature includes a first end structured to pass through the opening of the cover and a second end opposite the first end, the second end including an opening therein, said spring engaging the armature within the opening of the second end thereof, and wherein the armature slidably engages the thermoplastic bushing at said conduit.

* * * * *